US007133033B1

(12) United States Patent
Sawyer et al.

(10) Patent No.: US 7,133,033 B1
(45) Date of Patent: Nov. 7, 2006

(54) ACTUATOR FOR A SWITCH

(75) Inventors: Anthony M. Sawyer, Dorset (GB); Derek Higbee, Hampshire (GB)

(73) Assignee: Advanced Input Devices UK Limited, Hampshire (GB)

( * ) Notice: Subject to any disclaimer, the term of this patent is extended or adjusted under 35 U.S.C. 154(b) by 0 days.

(21) Appl. No.: 09/454,064

(22) Filed: Dec. 2, 1999

(51) Int. Cl.
*G09G 5/00* (2006.01)
*H01H 1/50* (2006.01)

(52) U.S. Cl. ..... 345/184; 345/168; 200/251; 200/261

(58) Field of Classification Search ..... 345/156–158, 345/160, 162, 168, 169, 172, 184; 200/502, 200/520, 521, 523, 526–530, 533, 557, 249, 200/38 BA, 251, 256, 259, 261, 286
See application file for complete search history.

(56) References Cited

U.S. PATENT DOCUMENTS

| | | | | | |
|---|---|---|---|---|---|
| 3,646,297 | A | * | 2/1972 | Anthony | 200/153 LB |
| 3,746,813 | A | * | 7/1973 | Brown | 200/157 |
| 3,772,484 | A | * | 11/1973 | Roeser | 200/4 |
| 3,895,205 | A | * | 7/1975 | Tharp | 200/340 |
| 3,974,351 | A | | 8/1976 | Solov et al. | 200/159 R |
| 4,032,734 | A | * | 6/1977 | Burch | 200/407 |
| 4,276,461 | A | * | 6/1981 | Piber | 200/329 |
| 4,590,339 | A | * | 5/1986 | Scott-Jackson et al. | 200/6 A |
| 4,749,878 | A | * | 6/1988 | Snyder et al. | 327/114 |
| 4,820,162 | A | * | 4/1989 | Ross | 434/45 |
| 4,866,223 | A | * | 9/1989 | Collins et al. | 200/61.16 |
| 4,958,071 | A | * | 9/1990 | Scott-Jackson et al. | 250/229 |
| 5,004,080 | A | * | 4/1991 | Wada | 188/282.4 |
| 5,059,939 | A | * | 10/1991 | Wu | 338/93 |
| 5,087,803 | A | * | 2/1992 | Kurtz | 200/526 |
| 5,113,179 | A | * | 5/1992 | Scott-Jackson et al. | 345/161 |
| 5,228,356 | A | * | 7/1993 | Chuang | 74/471 XY |
| 5,291,336 | A | * | 3/1994 | Miles | 359/808 |
| 5,417,137 | A | * | 5/1995 | Krasny et al. | 84/484 |
| 5,617,946 | A | * | 4/1997 | Acampora et al. | 200/407 |
| 5,921,381 | A | * | 7/1999 | Von Arx | 200/345 |
| 6,016,097 | A | * | 1/2000 | Gardner | 338/47 |
| 6,229,104 | B1 | * | 5/2001 | Matsui | 200/4 |
| 6,270,251 | B1 | * | 8/2001 | Bron | 368/320 |
| 6,284,992 | B1 | * | 9/2001 | Richter | 200/344 |
| 6,292,170 | B1 | * | 9/2001 | Chang et al. | 345/156 |
| 6,696,915 | B1 | * | 2/2004 | Pan | 338/198 |
| 6,717,086 | B1 | * | 4/2004 | Sawyer et al. | 200/526 |

FOREIGN PATENT DOCUMENTS

| | | | |
|---|---|---|---|
| CA | 1267434 | | 4/1990 |
| FR | 2237294 | | 7/1973 |
| FR | 2237294 | A * | 3/1975 |
| GB | 0814750 | | 6/1959 |
| GB | 1518043 | | 7/1978 |
| GB | 2229860 | | 10/1990 |
| GB | 2229860 | A * | 10/1990 |

* cited by examiner

*Primary Examiner*—Bipin Shalwala
*Assistant Examiner*—Jeff Piziali
(74) *Attorney, Agent, or Firm*—Schneck & Schneck; Thomas Schneck

(57) ABSTRACT

An actuator for a switch, the actuator being movable between on and off positions against an adjustable resilient bias to provide a first signal when said actuator is in said on position and a second signal when said actuator is in said off position.

17 Claims, 2 Drawing Sheets

ACTUATOR FOR A SWITCH

FIELD OF THE INVENTION

This invention relates to actuators for switches, and more particularly—but not exclusively—to actuators for switches for use in computer systems.

BACKGROUND OF THE INVENTION

Over the last few decades, the use of computers has become widespread in business, education and at home. Modern computers are controllable by way of graphical user interfaces (GUIs) which allow a user to control the computer simply by manipulating a cursor to select commands from lists of alternatives displayed in pull-down menus on the screen of the computer.

The cursors employed in GUIs are designed to be controlled by a pointing device rather than a keyboard, although in practice control is often duplicated on the keyboard so that the computer can still be controlled if the pointing device should fail. Various pointing devices have been developed for control of a cursor in a GUI environment. The pointing devices are also typically provided with one or more switches or buttons for user selection of system functions. Separate switching modules may also be provided.

All of these previously proposed pointing devices may easily be manipulated by an able-bodied user to control a cursor in a GUI, and thus to control a computer. These modern computers can be controlled to perform a large number of functions such as speech replication and global communication through the internet and through modern to modern connections.

Given the great utility of modern computers, it would be highly desirable if they could be effectively utilised by mentally and physically disabled persons to perform a variety of different functions. To this end, various pointing devices have been developed which cater for the special needs of disabled users. These devices provide improved mechanisms for the control of an on-screen cursor, but they typically do not address the problems associated with the user selection of computer system functions.

For example, some mental and physical disabilities are such that the disabled person is incapable of illustrating the fine motor control necessary to depress keys of a keyboard or to depress buttons on a conventional pointing device to select functions of, or perform tasks on, a computer system. Other disabled persons suffer from problems associated with hand shake, for example, that cause a repeated depression of a button when they only wanted to press the button once. As a consequence of this, these disabled persons can be unable to effectively operate modern GUI-driven computers.

SUMMARY OF THE INVENTION

In accordance with an aspect of the invention, there is provided an actuator for a switch, the actuator being movable between on and off positions against an adjustable resilient bias to cause said switch to provide a first signal when said actuator is in said on position and a second signal when said actuator is in said off position.

This aspect of the invention alleviates these problems by providing an actuator wherein the resilient bias is adjustable to allow the resistive force against which the actuator is depressed to be varied to take account of the particular disability of the user. For example, for those users who lack sufficient strength to effectively utilise conventional switches, the resistive force (i.e. the resilient bias) can be decreased so that a lesser pressure is required. Similarly, for those persons who suffer from hand shake, for example, the resistive force (i.e. the resilient bias) can be increased so that a definite depressive movement is required to activate the switch and so that relatively small hand movements, caused by a hand tremor for example, do not cause the switch to be activated.

Preferably, said resilient bias is adjusted by rotating said actuator. Preferably, said resilient bias is provided by a resiliently flexible elongate arm. The actuator may be movable to bear upon said elongate arm to flex the same. The resilient bias may be adjusted by varying a distance between at least two support points of a resiliently flexible elongate arm that provides said bias.

Preferably, increasing the distance between the support points decreases the resilience of the flexible arm. More preferably, decreasing the distance between the support points increases the resilience of the flexible arm.

Preferably, the support points each comprise a body having a cam follower that is fittable into and moveable in a cam track formed in a supporting plate. The cam track may be a spiral cam track.

Preferably, the support points are each movable in a respective radial slot formed in a top plate that is mountable over said supporting plate, rotation of said top plate causing said cam followers to move along said cam track to increase or decrease the distance between said support points.

The thickness of said arm may vary along its length. End portions of said arm may be thinner than a central portion thereof.

Preferably, said actuator is moveable to bear upon said arm, whereupon said arm bears upon switching means to activate and/or deactivate the same. The switching means may comprise a microswitch.

A second aspect of the invention provides a switch comprising an actuator as described herein.

A third aspect of the invention provides an actuator for a switch comprising: a button moveable upon the application of a force from a first position to a second position, and means for providing a resilient bias capable of acting against said force, said bias providing means being adjustable to vary the force required to move said button from said first position to said second position.

A fourth aspect of the invention provides a switch comprising: a button moveable upon the application of a force from a first position to a second position; resilient bias providing means for providing a resilient bias acting against movement of said button from said first position to said second position; and switching means operable to provide an output signal when said button is moved, or once said button has been moved, from said first position to said second position, wherein means are provided for adjusting said resilient bias thereby to vary the force required to move said button from said first position to said second position.

A fifth aspect of the invention provides an actuator for a switch comprising: a button moveable against a resistive force from a first position to a second position, means for providing said resistive force, and means for adjusting said resistive force.

BRIEF DESCRIPTION OF THE DRAWINGS

Embodiments of the invention will now be described by way of example only with reference to the accompanying drawings, in which.

DESCRIPTION OF THE PREFERRED EMBODIMENTS

Figure 1:
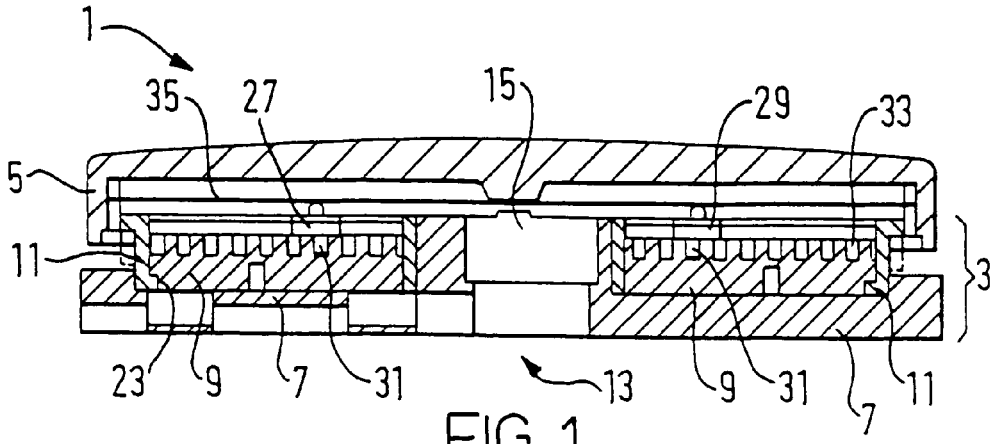
FIG. 1 is a cross-sectional view through a switch according to an aspect of the invention.

With reference to FIG. 1, a switch 1 comprises a housing 3 and an actuator 5 mounted for movement with respect to the housing 3.

The housing 3 comprises a base plate 7, a cam plate 9 and a top plate 1. The cam plate 9 is secured to the base plate 7, and the top plate 11 is fitted over the cam plate 9 and is rotatable with respect thereto. The base plate 7 is provided with a cavity 13 and a microswitch 15 is fitted therein. The top plate 11 is attached, preferably releasably, to the actuator 5, and the top plate 11 and actuator 5 are rotatable with respect to the base plate 7 and cam plate 9. The microswitch could be connected to a computer system, and the switch 1 could be used to select functions of, or perform tasks or, that system. The actuator 5 is preferably connected to the top plate by a series of complementary interengaging hooks, wherein the hooks on the actuator 5 engage with hooks on the top plate 11 to securely hold the one to the other. This arrangement is particularly advantageous as the hooks also act as a pivot point when pressure is applied to an edge portion of the actuator.

Figure 2A:
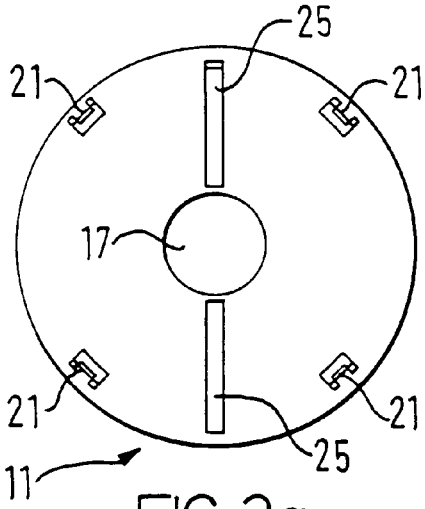
FIGS. 2*a* to 2*c* show various views of a component of the switch of FIG. 1.
Figure 2C:
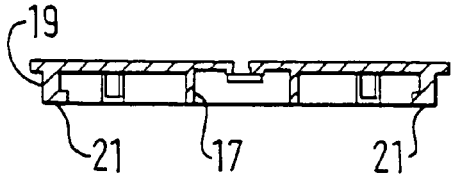
Figure 2B:
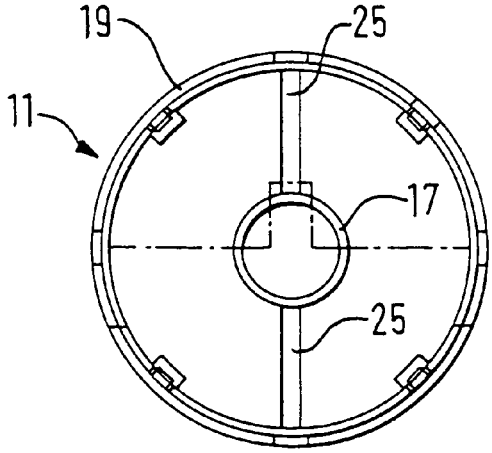

FIGS. 2*a* to 2*c* show various views of the top plate 11. As can be seen from these figures, the top plate 11 comprises an annular body having an elongate central channel 17 and an outer peripheral wall 19 extending substantially in parallel to the wall of the channel 17. The free end of the peripheral wall 19 is provided with a lug 21 which is fittable, possibly snap-fittable, in a co-operating groove 23 in the cam plate 9 (see FIG. 3*b*).

The top plate 11 is provided, in this embodiment, with a pair of slots 25—one either side of the channel 17. The slots 25 each provide a guide for a respective support 27, 29 movably located therein. One end of each support is provided with a cam follower 31 that is fittable into a preferably spiral cam track 33 formed in the cam plate 9. The other end of each support 27, 29 is provided with a supporting projection that abuts against an elongate arm 35 provided on the underside of the actuator 5. The elongate arm 35 is resiliently deflectable against a resilient bias that differs in degrees in dependence upon the distance between the supports 27, 29. If the distance between the supports 27, 29 is increased then the resilient bias against which the actuator is deflected will decrease. Similarly, if the distance between the supports 27, 29 is decreased then the resilient bias against which the actuator is deflected will increase. In the preferred construction, depression of the actuator causes a projection on the underside thereof to bear against the elongate arm 35, which bears in turn upon the microswitch 15 to activate the same. Releasing the actuator releases the microswitch 15 and deactivates the same. In an alternative construction, the microswitch could remain in a given state until the actuator is depressed a second time to cause the microswitch to change to another state.

Whilst the cam track shown in the drawings and described herein is formed as a spiral, it will be appreciated that the cam track may have alternative forms. For example, the cam track could simply comprise a radially inwardly extending groove for each of the cam followers.

The elongate arm 35 may be of varying thicknesses and is preferably thicker in the middle portion than at end portions. Such a construction aids the operation of the device as the thicker portion is more difficult to flex than the thinner portions. Thus, the force required to flex the elongate arm is further increased as the distance between the supports is reduced. The elongate arm rests upon the supports 27, 29 in use and the ends of the arm are moveable within the actuator 5.

Figure 3A:
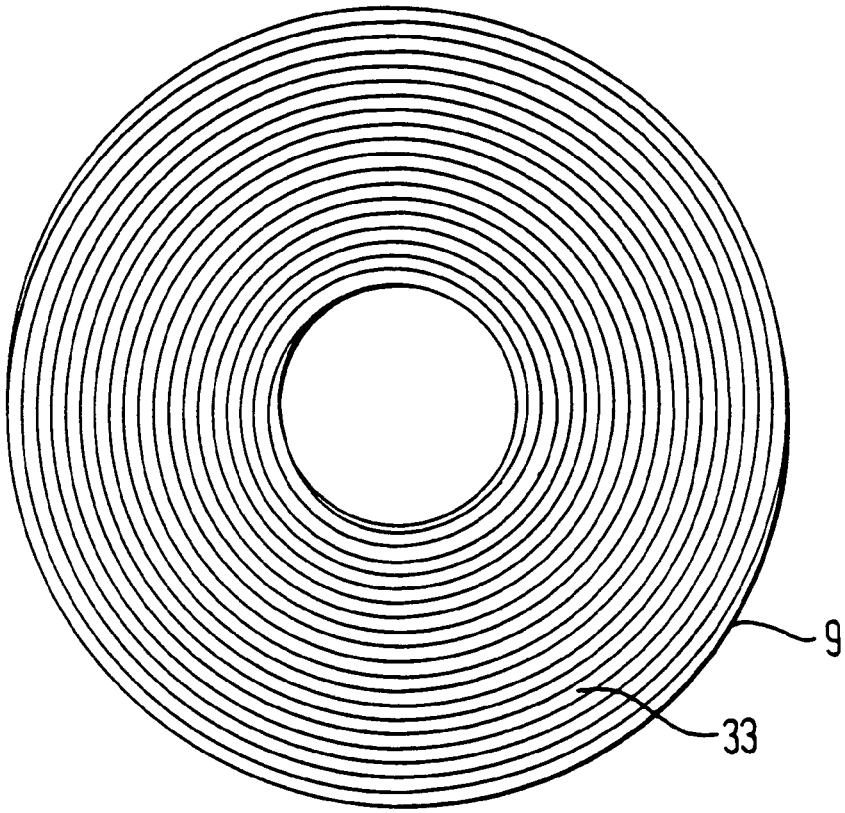
FIGS. 3*a* and 3*b* show various views of another component of the switch of FIG. 1.
Figure 3B:
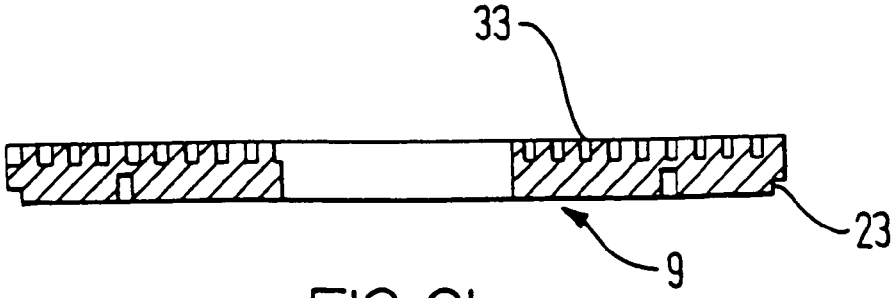

FIG. 3*a* is a plan view of the cam plate 9 showing the spiral cam track 33 formed therein, and FIG. 3*b* is a lateral cross-sectional view of the cam plate 9. The groove 23 with which the lug 21 on the free end of the peripheral wall 19 co-operates is clearly visible in FIG. 3*b*.

To assemble the switch 1, the cam followers of the supports 27, 29 are first located in appropriate points of the cam track 33 in the cam plate 9. Preferably, the cam followers are inserted at diametrically opposite points on either side of the channel 17 so that the elongate arm 35 is evenly supported. The top plate 11 is then fitted over the cam plate 9 to allow at least supporting projections of the supports 27, 29 to project through respective ones of the slots 25. The top plate 11, cam plate 9 and supports 27, 29 are then fitted onto the base plate 7, and the cam plate 9 is secured to the base plate 7. The top plate 11 and supports 27, 29 are then freely rotatable about the cam plate 9 and base plate 7. The elongate arm 35 is then mounted on the supports 27, 29, and the actuator 5 is fitted to the top plate 11 (by way of the interengaging hooks described above) so that the elongate arm 35 abuts against a protrusion formed on the underside of the actuator 5. The actuator 5 is not rotatable with respect to the top plate 11, and thus a rotation of the actuator 5 will cause the actuator 5, elongate arm 35, top plate 11 and supports 27, 29 to rotate about the cam plate 9 and base plate 7. The actuator 5 is, of course, movable towards and away from the top plate 11.

If, as mentioned above, the actuator 5 is rotated, then the cam followers of the supports 27, 29 will follow the spiral cam track 33 and the supports will move radially outwards or radially inwards depending upon the direction of actuator rotation. Radially inward or outward movement of the supports will vary the ease with which the actuator may be deflected against the resilient bias provided by the elongate arm 35.

Thus, it may be seen that the degree of resistance to actuator deflection may easily be adjusted to take account of the user's particular disability. For example, for those users with poor physical strength the resilience can be adjusted (by rotating the actuator and connected components) to increase the distance between the supports and thus to decrease the resistance to actuator deflection. Similarly, for those users with handshake or poor motor control, the resilience can be adjusted (by rotating the actuator and connected components) to decrease the distance between the supports. Decreasing the distance between the supports will increase the resistance to actuator deflection to such a point where a definite movement is required, thereby alleviating problems caused by accidental switch activation.

The actuator described herein is particularly well suited for use with a switch in a computer system to select functions of, or to perform tasks on that system. However, it will be appreciated that the switch could alternatively be used in a variety of different circumstances. Accordingly, the disclosure given herein is not to be interpreted as being limited to an actuator of a switch exclusively for use in a computer system.

The actuator described herein may be effectively retrofitted to existing switch units.

It will be understood that the invention has been described herein by way of example only and that modifications may be made within the scope thereof.

For example, the above disclosure has described a switch employing a pair of supports each located in a respective slot. It will be appreciated that a greater number of supports and slots may be provided if desired.

The cam track may also be formed such that the resiliency of the actuator is not freely adjustable. In such an arrangement, the resiliency of the actuator would be adjustable between predetermined graduated levels.

In addition, whilst the above described switch employs a microswitch that is directly acted upon by the elongate arm, it will be appreciated that alternative arrangements are feasible. For example, the switch could be an optical switch, with the arm having a blanking plate mounted thereon that is moveable to make or break a beam of light to an appropriate detector. Alternatively, the arm could indirectly act upon the switch by one of a number of different means.

What is claimed is:

1. A variable bias actuator for a switch comprising, a housing having a fixed plate with a central portion and a rotatable plate at least partially closing the central portion, one of the plates mounting a depressible actuator contact surface;

a force responsive switch mounted in the central portion in fixed relation to the other of said plates, the switch being electrically responsive to depressive contact by the actuator contact surface;

a resilient bias arm mounted in a position applying bias against the actuator contact surface resisting depressive contact and communicating a first force to the switch upon depressive contact; and means for supporting the resilient bias arm at radially variably spaced apart regions, said means moveable with relative rotation of the rotatable plate in a manner wherein rotation of the rotatable plate changes the spacing between the spaced apart support regions thereby changing the resiliency of the resilient bias arm, allowing a changed resistance to depressive contact against the actuator contact surface to produce a second force, different from the first force, thereby allowing different forces to operate the switch based upon relative rotation of the rotatable plate.

2. An actuator according to claim 1, wherein said resiliency of said arm is changed by rotating said actuator contact surface, and wherein said actuator contact surface and said arm are rotatable relative to said fixed plate.

3. An actuator according to claim 2, wherein said arm is a flexible elongate arm.

4. An actuator according to claim 3, wherein said actuator contact surface is movable to bear upon said elongate arm to flex the same.

5. An actuator according to claim 1, wherein said means for supporting said arm are at least two support points.

6. An actuator according to claim 5, wherein increasing the spacing between the support points decreases the resiliency of the arm.

7. An actuator according to claim 6, wherein decreasing the spacing between the support points increases the resiliency of the arm.

8. An actuator according to claim 5, wherein the support points each comprise a body having a cam follower that is fittable into and moveable in a cam track formed in a supporting plate.

9. An actuator according to claim 8, wherein said cam track is a spiral cam track.

10. An actuator according to claim 9, wherein the support points are each movable in a respective radial slot formed in said rotatable plate that is mountable over said fixed plate, rotation of said rotatable plate causing said cam followers to move along said cam track to increase or decrease the distance between said support points.

11. An actuator according to claim 3, wherein the thickness of said arm varies along its length.

12. An actuator according to claim 11, wherein end portions of said arm are thinner than a central portion thereof.

13. An actuator according to claim 3, wherein said actuator contact surface is moveable to bear upon said arm, whereupon said arm bears upon said switch to activate and/or deactivate the same.

14. An actuator switch according to claim 13, wherein said switch comprises a microswitch.

15. An actuator according to claim 1, wherein movement of the actuator between an on position and an off position causes said switch to provide a first signal when said actuator is in said on position and a second signal when said actuator is in said off position.

16. An actuator according to claim 1, wherein said fixed plate has a peripheral lip.

17. An actuator according to claim 1, wherein said support means are two support points disposed beneath said resilient bias arm.

* * * * *

UNITED STATES PATENT AND TRADEMARK OFFICE

CERTIFICATE OF CORRECTION

PATENT NO. : 7,133,033 B1
APPLICATION NO. : 09/454064
DATED : November 7, 2006
INVENTOR(S) : Anthony M. Sawyer and Derek Higbee It is certified that error appears in the above-identified patent and that said Letters Patent is hereby corrected as shown below:

Column 3, lines 14-15, "…, a cam plate 9 and a top plate 1. …" should read:

-- …, a cam plate 9 and a top plate 11. … --.

Column 3, line 23, "… select functions of, or perform tasks or, that system. …" should read:

-- … select functions of, or perform tasks on, that system. --.

Signed and Sealed this

Ninth Day of December, 2008

JON W. DUDAS
*Director of the United States Patent and Trademark Office*